US006601812B2

(12) United States Patent
LeClair et al.

(10) Patent No.: US 6,601,812 B2
(45) **Date of Patent: *Aug. 5, 2003**

(54) KEYBOARD SUPPORT TRAY WITH RELEASABLE WEDGE LOCK

(75) Inventors: James L. LeClair, Waterloo (CA); Borge Peterson, Elmira (CA)

(73) Assignee: Waterloo Furniture Components, Ltd., Kitchener (CA)

( * ) Notice: Subject to any disclaimer, the term of this patent is extended or adjusted under 35 U.S.C. 154(b) by 0 days.

This patent is subject to a terminal disclaimer.

(21) Appl. No.: 10/267,227

(22) Filed: Oct. 9, 2002

(65) Prior Publication Data

US 2003/0025055 A1 Feb. 6, 2003

Related U.S. Application Data

(63) Continuation of application No. 10/022,432, filed on Dec. 31, 2001, now Pat. No. 6,460,816, which is a continuation of application No. 09/994,984, filed on Nov. 27, 2001, which is a continuation of application No. 09/016,013, filed on Jan. 30, 1998, now Pat. No. 6,322,031.

(51) Int. Cl.[7] ..... E04G 3/00

(52) U.S. Cl. ..... 248/286.1; 248/118; 248/248.1; 248/188.1

(58) Field of Search ..... 248/286.1, 118, 248/284.1, 918, 188.1, 188.3, 276.1, 286

(56) References Cited

U.S. PATENT DOCUMENTS 5,037,054 A * 8/1991 McConnell ..... 248/284.1
5,292,097 A * 3/1994 Russell ..... 248/281.11
6,322,031 B1 * 11/2001 LeClair et al. ..... 248/286.1

* cited by examiner

*Primary Examiner*—Kimberly Wood
(74) *Attorney, Agent, or Firm*—Banner & Witcoff Ltd.

(57) ABSTRACT

A keyboard support assembly includes first and second arms which interconnect from a desktop mounting plate to a keyboard support platform. The first arm connects directly by pivot connections between the desk mounting plate and the keyboard support platform. The second arm connects from the desk mounting plate to the first arm and acts as a brace for the first arm. A locking wedge mechanism locks the arms together when weight is placed on the support platform due to engagement of an actuating arm which projects from the keyboard support platform and activates the wedge mechanism. Release of the weight or force on the platform releases the wedge locking mechanism and permits pivotal movement of the arms and reorientation of the platform.

4 Claims, 2 Drawing Sheets

KEYBOARD SUPPORT TRAY WITH RELEASABLE WEDGE LOCK

CROSS REFERENCE TO PREVIOUS APPLICATION

This application is a continuation of Ser. No. 10/022,432 filed Dec. 3, 2001 U.S. Pat. No. 6,460,816 which is a continuation of Ser. No. 09/994,984 filed Nov. 27, 2001, which is a continuation of Ser. No. 09/016,013 filed Jan. 30, 1998 U.S. Pat. No. 6,322,031.

BACKGROUND OF THE INVENTION

This invention relates to an improved adjustable support mechanism for a computer keyboard or the like. Various mechanisms for supporting keyboards associated with computer terminals have been the subject matter of numerous patents. Smeenge in U.S. Pat. No. 4,616,798, entitled Adjustable Support for CRT Keyboard, discloses a mechanism which includes first and second and sets of parallel, equal length, articulating arms that link first and second brackets with a keyboard platform at one end and a sliding plate attached beneath a desktop at the opposite end. The parallel arms are pivotally connected to the platform and bracket plate and move in a vertical plane to maintain the keyboard support platform in a generally horizontal position regardless of the position of the platform relative to the desktop. During storage of the keyboard support platform, the arms articulate or pivot so that the platform is then lowered to a retracted position beneath the level of the desktop. The arms may be locked in a fixed orientation by a threaded handle or lever which precludes pivotal motion of one or more arms.

Other keyboard support constructions are illustrated in U.S. Pat. Nos. 4,625,657; 4,632,349; 4,706,919; 4,776,284; 4,826,123; and 4,843,978. Each of these patents employs a parallel arm type mechanism that allows adjustment of the height of the keyboard support. Another keyboard support mechanism is disclosed in McConnell, U.S. Pat. No. 5,037,054, entitled Adjustable Support Mechanism for a Keyboard Platform. U.S. Pat. No. 5,037,054 teaches a keyboard support mechanism that employs non-parallel arms to support the keyboard platform. This mechanism does not necessarily maintain the keyboard platform in a horizontal position as the arms articulate. Thus, when the keyboard platform is stored under a table, the platform is re-oriented to supply greater access to the kneehole of a desk. The arms may be locked in a desired orientation by means of a threaded handle or lever.

The various prior art mechanisms discussed are useful in conjunction with standard desk equipment. They typically require a threaded handle or lever to lock the keyboard support platform at a desired height location. This type of mechanism, if not operated carefully, may not safely lock the keyboard platform in place. Thus, there has developed a need for improved keyboard support mechanisms for storage of a computer keyboard and which permit easy movement of the platform to a desired level. Additionally, another desired characteristic for such mechanisms is providing a stable surface for the keyboard. Further desirable is an improved mechanism which safely and securely locks a keyboard platform in a desired orientation and which permits easy release or unlocking of the platform from a fixed orientation.

SUMMARY OF THE INVENTION

In a principal aspect, the present invention comprises a keyboard support assembly which includes a support platform, for supporting a keyboard, connected by a first arm and second arm to a desk mounting plate. The first one of the arms is pivotally attached to both the platform and the mounting plate. The second arm interconnects the mounting plate to the keyboard support platform as well as the first arm and thus acts as a brace for the first arm. A locking mechanism, which is activated by pivotal actuation of or downward force on the keyboard platform, is provided so that upon application of a downward force to the keyboard support platform, the first and second linkage arms are locked into a fixed position or orientation and maintained in that position. Removal of the force releases the locking mechanism permitting link arm movement and platform reorientation. The locking mechanism is preferably an arrangement of wedges or wedge members which interact to lock the first and second arms together upon application of downward force on the platform.

Thus, it is an object of the invention to provide a keyboard support assembly that includes a mechanism which maintains the orientation and location of a keyboard platform once the keyboard platform has been moved to a desired position.

Yet another object of the invention is to provide a computer keyboard support assembly that permits release linkage arms connecting the platform to a mounting plate quickly and easily to thereby permit movement of the platform into a storage position under a work surface or any other desired orientation or position.

Another object of the invention is to provide a computer keyboard support assembly which allows movement and locking of the platform in an almost infinite number of generally horizontal, keyboard orientations.

These and other objects, advantages, and features of the invention will be set forth in the detailed description which follows.

BRIEF DESCRIPTION OF THE DRAWING

In the detailed description which follows, reference will be made to the drawing comprised of the following Figures:

FIG. 1 is a top plan view of an embodiment of the invention which incorporates the locking mechanism activated by interaction of the keyboard support platform and the linkage arms which extend between that platform and the mounting plate attaching the assembly to a work surface, desktop or the like;

DESCRIPTION OF THE PREFERRED EMBODIMENT

Figure 1:
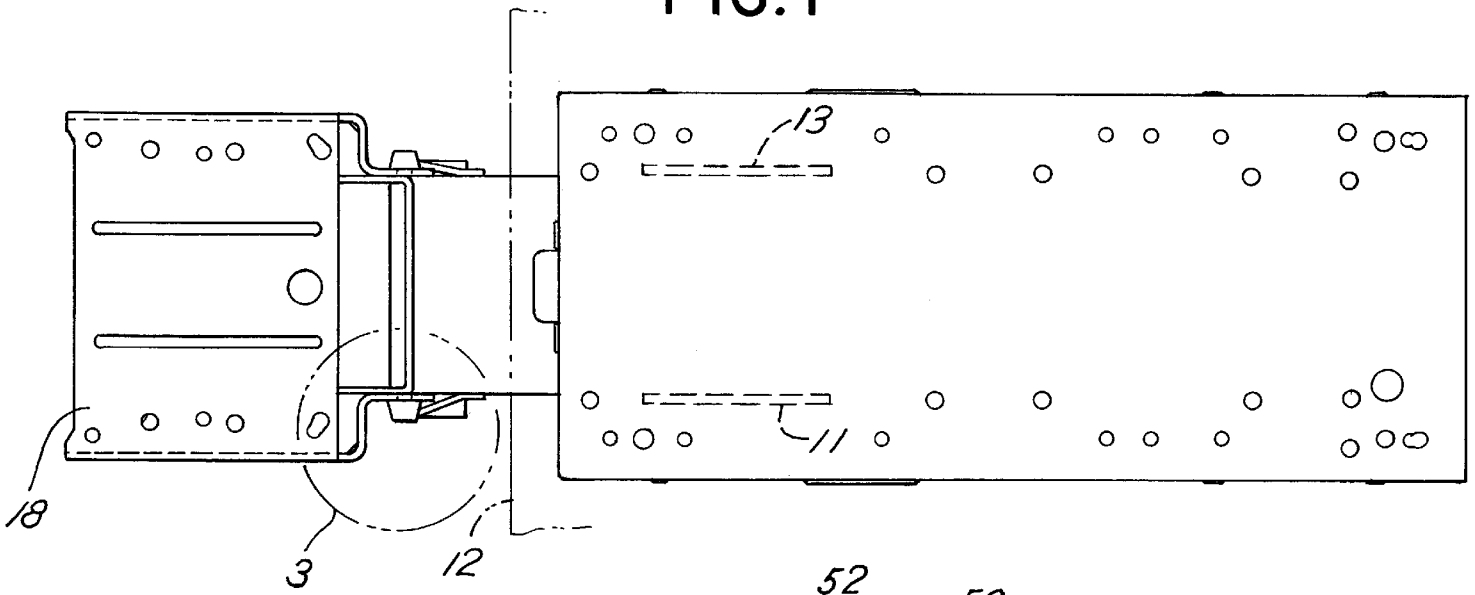

Referring to the Figures, there is illustrated a keyboard support assembly which incorporates the subject matter of the invention. A first support bracket or mounting plate 10 is mounted or attached to the underside of a desktop or work surface 12. More specifically, the first bracket or plate 10 includes a slide mechanism which enables sliding movement of the bracket or plate 10 in a channel 14 between the positions shown in FIG. 2 in phantom and solid lines. The channel 14 is thus attached to the underside of a desktop 12, and the plate or bracket 10 slides in side tracks in the channel 14. The connection between the channel 14 and the plate 10 may be a pivotal connection so that the plate 10 will slide and pivot relative to the channel 14.

The bracket 10 is connected with and supports a separate keyboard support platform 18 through a linkage which is comprised of a first arm 20 and a second arm 22. The arm 20 is attached by means of a pivot rod 24 to depending bracket plate 11 of bracket 10 and may pivot about the axis of rod 24. That is, parallel, spaced, depending bracket plates 11, 13 retain a pivot rod 24 suspended beneath sliding plate 10. Here it should be noted that the description focuses on one set of arms 20, 22. However, the arms 20, 22 may be constructed in tandem just as are the bracket plates 11, 13. The arms 20, 22 may also be a single member (as depicted) having a U channel shape.

The first arm 20 is attached at its opposite end to the platform 18 by means of a pivot rod 26 which extends between and connects to projecting tabs or arms 28 of platform 18. The axes of rotation or pivotal axes associated with the pins 24 and 26 are generally parallel one to the other. A spiral spring 30 is wrapped around pin 24 and includes opposite ends which engage the plate 10 and arm 20 respectively causing the arm 20 to be biased to pivot about the pin 24 clockwise or upwardly toward the upper position of the assembly illustrated in FIG. 2. It is noted that in FIG. 2 the assembly is depicted in phantom and the phantom position is that which the assembly may move to upon actuation of the spring 30 against the arm 20.

Figure 2:
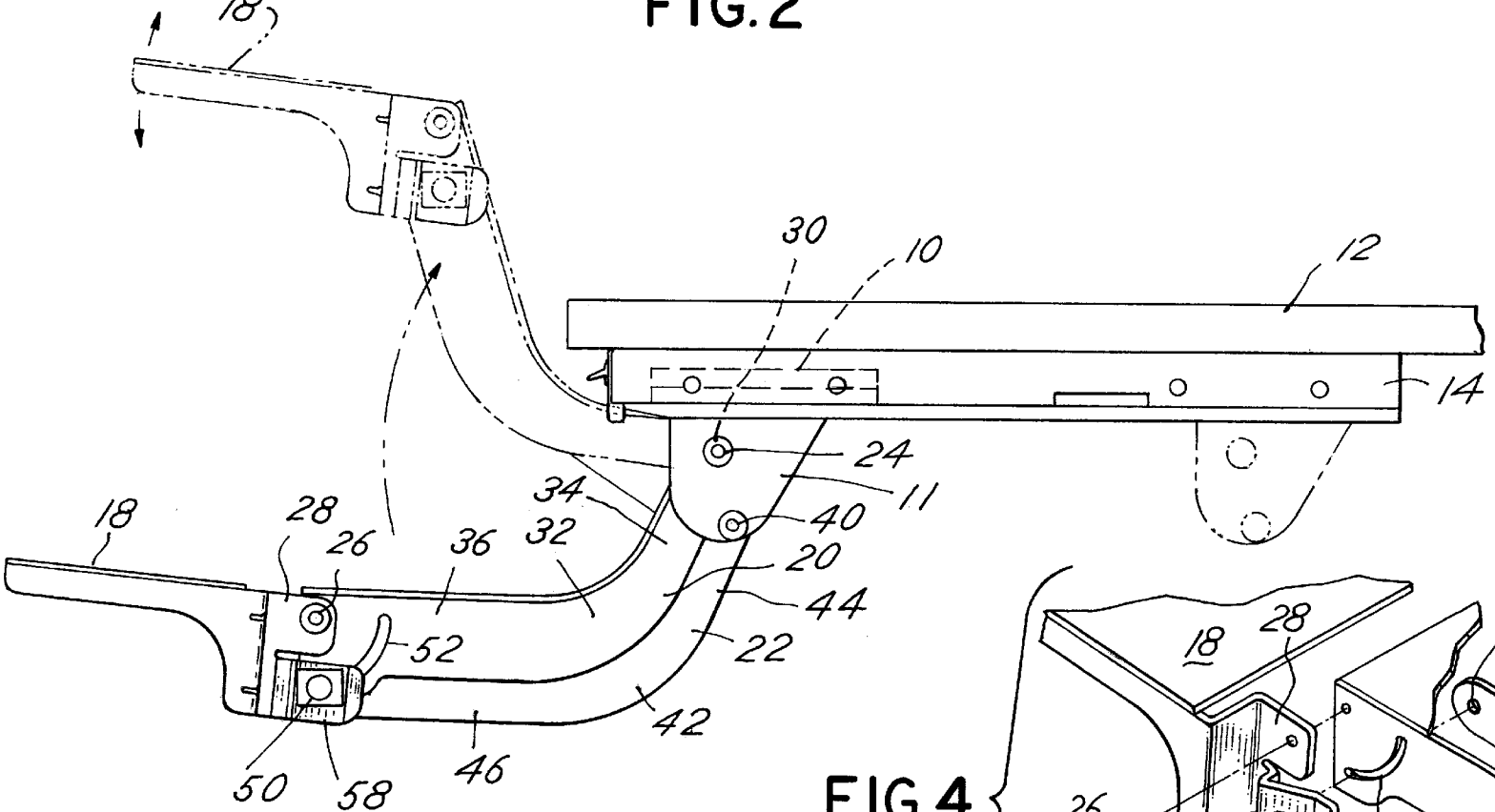
FIG. 2 is a side elevation of the embodiment depicted in FIG. 1.
Figure 4:
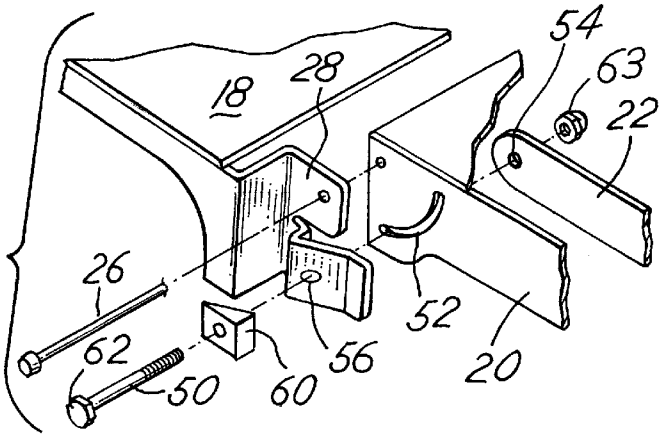
FIG. 4 is a partial isometric view of the wedge lock mechanism of the invention depicted in FIG. 3.

The particular configuration of the arm 20 may be varied. In the embodiment depicted, the arm 20 has an arcuate connecting run 32 extending between a generally straight, first leg section 34 and a generally straight, second leg section 36. The arm 20 may thus curl outwardly from beneath a desk and upwardly above the horizontal plane of the desk. This enables the platform 18 to be elevated as depicted in FIG. 2 to a position significantly above the work surface 12.

Also connecting between the bracket 10 and more particularly, the bracket plates 11, 13 toward the computer support platform and bracket 18 is a second arm 22. The second arm 22 is attached to the bracket 10 by means of a pivot rod 40 which is generally parallel to and spaced downwardly from the rod 24. The arm 22, likewise, includes an arcuate section or run 42 connecting a first, generally straight leg 44 to a second, generally straight leg 46 similar to the construction of the first arm 20, again to enable the platform 18 to be raised to an elevated position.

Figure 3:
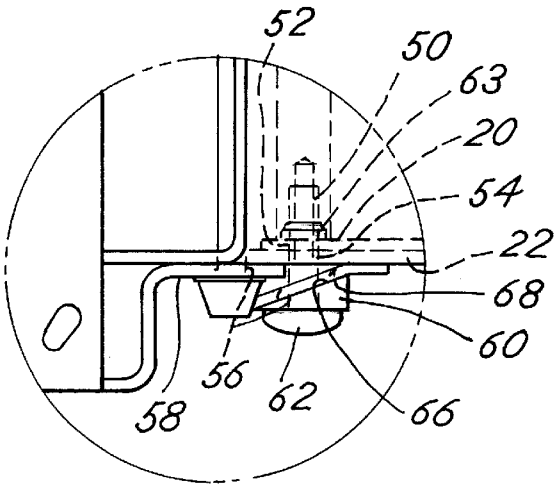
FIG. 3 is an enlarged, partial top plan view of the locking mechanism as shown in FIG. 1.

The connection between the second arm 22 and the platform or bracket 18 constitutes an important part of the invention. This connection is depicted in FIG. 3 in greater detail and includes a pin 50 which projects through an arcuate slot 52 in the first arm 20 and engages into and passes through an opening 54 in the second arm. The arcuate slot 52 permits the pin 50 to move or slide therein as the arm 20 moves relative to the arm 22 during pivotal action of arm 20 about pins 24, 26. Such sliding movement further serves to reorient the platform 18 (which is also connected to pin 50) and thereby keep the platform 18 horizontal. The pin 50 thus passes through a small slot opening 56 in an actuator or extension arm 58 extending from the platform 18. The pin 50 also extends through a wedge block or lock member 60. The wedge lock or block member 60 rides freely in an axial direction on the pin 50, slot opening 56 of actuator arm 58, opening 54 and slot 52. It is held in position by the head of the pin 50, namely head 62. The opposite end of the pin 50 may include a nut 63 or some other mechanism to preclude axial movement; for example, a connection tube which connects to the opposite side of the bracket platform 18. Importantly, the axial extent or length of pin 50 between head 62 and a nut 63 is intermediate the maximum and minimum combined thickness or axial dimension of arms 20, 22, actuator arm 58 and wedge block 60. The wedge block 60 includes an inclined surface 66 which engages with and slides against an inclined surface 68 associated with the actuator arm 58.

In operation, as a weight or force is placed upon the platform 18 (in a counterclockwise direction in FIG. 2), the platform 18 will tend to pivot about the axis of rod 26 causing the bracket actuator arm 58 to move slightly in the direction of force. This causes the actuator arm 58 and, more particularly, surface 68 of said actuator arm 58 to move against the wedge block 60. Thus, the surface 68 engages against the surface 66. This causes the opposite ends of pin 50 (head 62, nut 63) to engage the arms 20, 22, block 60 and arm 58 to be compressed together and thereby tightly engage or lock the arm 20 against the arm 22. This effectively locks the assembly at least partially by friction since when arms 20, 22 are locked, the assembly cannot pivot.

To release the engagement of the arms 20 and 22, the platform 18 is moved in the clockwise direction as depicted in FIG. 2 or force is placed on the platform 18 so as to tend to move it in the clockwise direction. This releases or moves the actuator 58 and, more particularly, the surface 68 slides along the surface 66 thereby decompressing the assemblage of parts and releasing the engagement of the arms 20 and 22. When so released, the arms 20 and 22 may then be moved or pivoted to a desired position. In review, pressing down or moving the platform 18 in the counterclockwise direction will lock the arms 20, 22 again in a fixed position. An opposite direction of force and movement releases the arms 20, 22.

Of course, the platform 18 may have a pivotal connection between the platform 18 and a keyboard plate. Also, various wedge locking mechanisms or other locking mechanisms may be used to connect the arms 20, 22 in response to slight pivotal movement of the actuator arm 18. Thus, while there has been set forth a preferred embodiment of the invention, it is to be understood that the invention is limited only by the following claims and equivalents.

What is claimed is:

1. An assembly of pivotal arms for attaching and supporting a platform to a work support comprising, in combination:

a first bracket member for attachment to a work support;

a second bracket member for attachment to a platform;

a first arm having first and second ends pivotally attached respectively to the first bracket member and the second bracket member;

a second arm having third and fourth ends pivotally attached respectively to the first bracket member and second bracket member;

one of said bracket members including an inclined surface;

one of said arms including a wedge member having a wedge member inclined surface in opposed slidable relation to the bracket member inclined surface, said wedge member including a pivot pin for holding the wedge member inclined surface in opposed slidable relation to the inclined surface and for simultaneously connecting the said one arm to the said one bracket member to prevent pivotal movement of said arms.

2. The assembly of claim 1 wherein the inclined surface is formed on the first said bracket member.

3. The assembly of claim 1 wherein a second wedge member is affixed to the other of said arms by a pivot pin.

4. The assembly of claim 3 wherein the other of said arms includes a guide slot for the pivot pin.

* * * * *